US009749735B1

(12) United States Patent
Silver et al.

(10) Patent No.: US 9,749,735 B1
(45) Date of Patent: Aug. 29, 2017

(54) WAVEGUIDE

(71) Applicant: Bose Corporation, Framingham, MA (US)

(72) Inventors: Jason Silver, Framingham, MA (US); Lifun Lin, Lincoln, MA (US); William Berardi, Grafton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/202,809

(22) Filed: Jul. 6, 2016

(51) Int. Cl.
*H04R 1/30* (2006.01)
*H04R 1/28* (2006.01)
*H04R 1/22* (2006.01)

(52) U.S. Cl.
CPC ..... *H04R 1/288* (2013.01)

(58) Field of Classification Search
CPC .... H04R 1/288; H04R 1/2869; H04R 1/2876; H04R 1/22; H04R 1/2815; H04R 1/2819; H04R 1/30; H04R 1/34
USPC ..... 181/199, 196, 146, 151, 166; 381/338, 381/339, 354
See application file for complete search history.

(56) References Cited

U.S. PATENT DOCUMENTS 3,617,654 A * 11/1971 Heidrich ..... H04R 1/2896 181/166
4,044,855 A * 8/1977 Kobayashi ..... H04R 1/22 181/151
4,135,600 A * 1/1979 Ogi ..... H04R 1/2826 181/156
4,350,724 A * 9/1982 Marrs ..... H04R 1/288 181/175
4,356,882 A * 11/1982 Allen ..... H04R 1/2803 181/151
4,657,108 A * 4/1987 Ward ..... H04R 1/2803 181/149
4,837,837 A * 6/1989 Taddeo ..... H04R 1/2819 181/146
4,893,695 A * 1/1990 Tamura ..... H04R 1/345 181/146
5,067,159 A * 11/1991 Kasai ..... H04R 1/02 181/144
5,109,422 A * 4/1992 Furukawa ..... H04R 1/023 181/160
5,111,509 A * 5/1992 Takeuchi ..... G10K 11/02 181/160
5,115,883 A * 5/1992 Morikawa ..... H04R 1/30 181/152
5,261,006 A * 11/1993 Nieuwendijk ..... H04R 1/227 181/146
5,373,564 A * 12/1994 Spear ..... H04R 1/2857 181/156
5,793,000 A * 8/1998 Sabato ..... H04R 1/025 181/151

(Continued)

*Primary Examiner* — Edgardo San Martin
(74) *Attorney, Agent, or Firm* — Brian M. Dingman; Dingman IP Law, PC

(57) ABSTRACT

A waveguide for conducting sound that is generated by a loudspeaker that is acoustically coupled to the waveguide. There is a duct with an external wall, an interior opening circumscribed by the wall, and an outlet, and an air-adsorbent structure coupled to an inside of the external wall of the duct such that the air adsorbent structure lines at least a portion of the wall. The apparent volume ratio of the air adsorbent structure is at least about 1.5.

21 Claims, 13 Drawing Sheets

(56) References Cited

U.S. PATENT DOCUMENTS 5,824,969 A * 10/1998 Takenaka ..... H04R 1/2857 181/145
6,771,787 B1 * 8/2004 Hoefler ..... H04R 1/2857 181/145
7,565,948 B2 * 7/2009 Parker ..... H04R 1/2857 181/148
7,614,479 B2 * 11/2009 Plummer ..... H04R 1/2857 181/148
7,623,670 B2 * 11/2009 Hoefler ..... H04R 1/2857 381/338
7,743,877 B2 * 6/2010 Saiki ..... H04R 1/2803 181/148
7,991,181 B2 * 8/2011 Saiki ..... H04R 1/2803 381/353
8,184,826 B2 * 5/2012 Matsumura ..... H04R 1/2803 181/149
8,630,435 B2 * 1/2014 Mellow ..... H04R 1/225 181/146
8,687,836 B2 4/2014 Lin
8,794,373 B1 8/2014 Lin
8,953,830 B2 * 2/2015 Skramstad ..... H04R 1/30 181/152
8,953,831 B2 * 2/2015 Jankovsky ..... G10K 11/025 181/192
8,991,549 B2 * 3/2015 Lin ..... B01D 53/0407 181/151
9,232,299 B2 * 1/2016 Lin ..... B01D 53/0407
9,357,289 B2 * 5/2016 Lin ..... B01D 53/0407
9,473,847 B2 * 10/2016 Shiozawa ..... H04R 1/20
2008/0170737 A1 * 7/2008 Saiki ..... H04R 1/2803 381/346
2010/0092019 A1 * 4/2010 Hoefler ..... H04R 1/345 381/338
2010/0329498 A1 * 12/2010 Rouvala ..... H04R 1/288 381/354
2012/0247866 A1 * 10/2012 Lage ..... H04R 1/2826 181/196
2015/0237437 A1 * 8/2015 Hu ..... H04R 1/1058 381/338
2016/0309254 A1 * 10/2016 Lembacher ..... H04R 1/28
2016/0345090 A1 * 11/2016 Wilk ..... B01D 53/04
2017/0064438 A1 * 3/2017 Wilk ..... H04R 1/288

* cited by examiner

WAVEGUIDE

BACKGROUND

This disclosure relates to a waveguide that conducts sound.

Waveguides can be effective to increase acoustic output power over what is possible by loading an acoustic driver with a sealed box, port or passive radiator.

SUMMARY

Coupling an air-adsorbing material to some or all of the interior wall of a waveguide can be effective to lower the speed of sound in the waveguide and thus lower its tuning frequency as well as smooth the waveguide's frequency response. A result is that audio quality can be substantially improved.

All examples and features mentioned below can be combined in any technically possible way.

In one aspect, a waveguide for conducting sound that is generated by a loudspeaker that is acoustically coupled to the waveguide includes a duct with an external wall, an interior opening circumscribed by the wall, and an outlet. There is an air-adsorbent structure coupled to an inside of the external wall of the duct such that the air adsorbent structure lines at least a portion of the wall. The apparent volume ratio of the air adsorbent structure is at least about 1.5. The apparent volume ratio may be at least about 2.2.

Embodiments may include one of the following features, or any combination thereof. The duct may have a length between where the loudspeaker is coupled to the duct and the duct outlet, and the air-adsorbent structure may line at least part of the wall over about the last 10% of the length, or about the first 10% of the length.

Embodiments may include one of the following features, or any combination thereof. The air-adsorbent structure may comprise an open-cell foam that carries particles of air-adsorbent material. The air-adsorbent material may comprise particles, particles are coupled to each other to form agglomerates, and the air-adsorbing material particles and agglomerates are coupled to the foam, wherein the air-adsorbent structure has structure openings in the agglomerates and structure openings between agglomerates, where at least some such structure openings are open to the outside environment, and wherein the openings in the air-adsorbent structure further comprise one or more channels through the thickness of the structure that have diameters of greater than the apparent diameter of the structure openings between agglomerates. The air-adsorbent structure may comprise a sheet of open-cell foam that carries particles of air-adsorbent material. The air-adsorbent structure may comprise a plurality of stacked sheets of the open-cell foam that carries particles of air-adsorbent material. The waveguide may further include spacers between stacked sheets, to allow ventilation between sheets.

Embodiments may include one of the following features, or any combination thereof. A thickness of the air-adsorbent structure may be less than about 3 mm, or it may be no more than about 25 mm. The ratio of an area of air adsorbent structure to the open area of the duct may be at least about 0.1 and may be no greater than 10.

Embodiments may include one of the following features, or any combination thereof. The duct may be tapered such that it is wider at the outlet than it is where it is coupled to the loudspeaker. The waveguide may further include at least one of a Helmholtz resonator, a screened cavity, and a waveguide shunt located along the length of the duct. An entrance to the Helmholtz resonator, a screened cavity, or a waveguide shunt may be at a location of a standing wave pressure maximum in the duct.

In another aspect a waveguide for conducting sound that is generated by a loudspeaker that is acoustically coupled to the waveguide includes a duct with an external wall, an interior opening circumscribed by the wall, and an outlet. There is an air-adsorbent structure comprising an open-cell foam that carries particles of air-adsorbent material, where the air-adsorbent structure is coupled to an inside of the external wall of the duct such that the air adsorbent structure lines at least a portion of the wall. The apparent volume ratio of the air adsorbent structure may be at least about 1.5, and the ratio of the area of the air adsorbent structure to the open area of the duct may be at least 0.1. The air-adsorbent structure may comprise a sheet of open-cell foam that carries particles of air-adsorbent material. The air-adsorbent structure may comprise a plurality of stacked sheets of the open-cell foam that carries particles of air-adsorbent material.

In another aspect a waveguide for conducting sound that is generated by a loudspeaker that is acoustically coupled to the waveguide includes a duct with an external wall, an interior opening circumscribed by the wall, and an outlet. There is an air-adsorbent structure comprising a plurality of stacked sheets of open-cell foam that carries particles of air-adsorbent material, where the air-adsorbent structure is coupled to an inside of the external wall of the duct such that the air adsorbent structure lines at least a portion of the wall. The ratio of an area of air adsorbent structure to the open area of the duct is at least 0.1 and is no greater than 10, and the apparent volume ratio of the air adsorbent structure is at least about 1.5. There may be spacers between the stacked sheets to allow for ventilation between sheets.

DETAILED DESCRIPTION

The term "waveguide" as used herein can include both acoustic waveguides (ducts that are sized to resonate at frequencies within the operating range of an acoustic driver) and horns (tapered ducts that provide impedance matching between an enclosed acoustic system and the surrounding environment). Such waveguides can be effective to increase acoustic output power over what is possible by loading an acoustic driver with a sealed box, port or passive radiator. However, waveguides can increase the number of high Q peaks and thus require damping of undesirable peaks and dips in the speaker output. The damping properties of an adsorptive material in a waveguide reduces the Q of the peaks of the loudspeaker frequency response and thus can smooth its frequency response.

The speed of a wave propagating down a waveguide, henceforth referred to as the speed of sound, determines the envelope for acoustic pressure and particle velocity. Thus, reducing the speed of sound lowers the tuning frequency. When the speed of sound is reduced, the frequency of waveguide response features (such as the resonances) is decreased without the need to increase the length of the waveguide. The speed of sound in a waveguide can be reduced by adding an air-adsorbent structure to the waveguide, where the air adsorbent structure has a bulk modulus that is less than the bulk modulus of air. Also, air-adsorbent structures in waveguides can increase the sensitivity of a system at the tuning frequency of the loudspeaker, which can flatten the frequency response since at the tuning frequency the output can be lower than that above the tuning frequency.

Figure 1A:
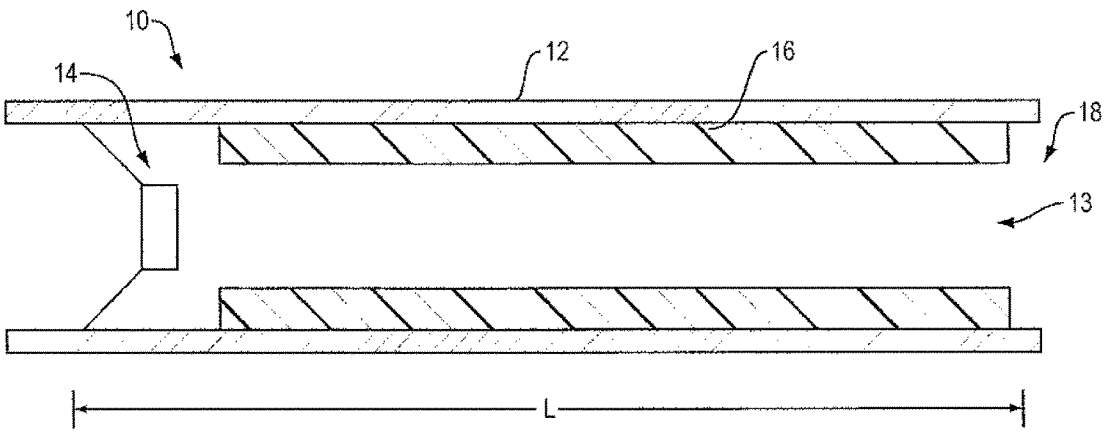
FIG. 1A is schematic cross-sectional view of an acoustic waveguide.

FIG. 1A is schematic cross-sectional view of acoustic waveguide 10 that has rectangular hollow waveguide duct 12 with acoustic transducer (driver) 14 acoustically coupled to the interior of duct 12. Waveguide ducts need not be rectangular, and need not have a constant cross-sectional area along their length. They can be straight, curved or stepped. This disclosure is not limited by any type, shape or configuration of a waveguide duct or a horn.

In this non-limiting example the rear or back side of driver 14 directly radiates into the interior 13 of duct 12. Sound propagates down duct 12 and is able to leave via mouth or outlet opening 18. There are other manners of acoustically coupling a driver to a waveguide duct or a horn that are not shown in the drawings, all of which are within the scope of the present disclosure. Several others include a front direct radiating driver with its back waveguide loaded; a front direct radiating driver with its back tapped into a waveguide; a horn loaded loudspeaker; a stepped waveguide; and a waveguide with stubs or shunts or Helmholtz resonators that damp acoustic output peaks.

The interior of duct 12 is, at least in part, lined with an air-adsorbing structure 16. The drawing depicts structure 16 lining the inside of all four walls of rectangular duct 12. However, the air-adsorbing structure need not be present on all of the walls, and not need cover the entire width of any of the walls. Further, the drawing depicts structure 16 lining most of the effective length "L" of the waveguide duct. However, as further explained below, the structure can line less than or more than the length shown. Also, the structure can line only the part of the waveguide duct near the transducer, only the part of the waveguide duct near the mouth, or any other part or length of duct 12.

Figure 1B:
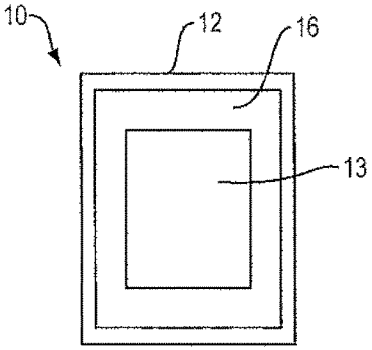
FIG. 1B is an end view of the waveguide of FIG. 1A.

FIG. 1B is an end view of the waveguide of FIG. 1A, showing structure 16 lining the interiors of the four walls of tube 12. Open interior space 13 is also shown. In the present disclosure, the thickness of structure 16 is sometimes discussed, as is the ratio (sometimes referred to as "Rz") of the cross-sectional area of the waveguide that is filled with air-adsorbing structure to the cross-sectional area that is not filled. Structure 16 can take the shape of one or more relatively thin sheets that contain an air-adsorbent material, but it need not take this shape. Other shapes are possible, including regular shapes, or irregular shapes that fit into irregular open volumes of the duct or horn. The structure shape can be arbitrary. It can be non-uniform, or it can be a flat sheet, for example. Any other shape could be made; this disclosure is not limited to any starting or final shape of the air-adsorbing structure, or any method of creating the final shape from a starting shape. Further details of air-adsorbent structures and methods by which they can be made are disclosed in U.S. patent application Ser. No. 14/973,987 filed on Dec. 18, 2015, the disclosure of which is incorporated herein by reference.

The air-adsorbing structures can include a three-dimensional, light-weight, unitary, skeletal, low-solid volume, porous open-celled foam scaffold having scaffold openings, at least some of which are open to the environment. The scaffold is preferably an open-celled foam made from a polymer, a metal or a ceramic. In one non-limiting example the scaffold openings make up at least about 50% of the volume of the foam; the scaffold openings preferably make up at least about 90% of the volume of the foam. The structure also includes air-adsorbing material that is coupled to the foam. In one non-limiting example, a hydrophobic binder is used to couple small particles of air-adsorbing material to each other to form agglomerates and couples particles and agglomerates to the foam scaffold. The air-adsorbing material is typically but not necessarily one or both of zeolite material (typically, a silicon-based zeolite) and powdered or granular activated carbon. Air adsorbing structures and their fabrication and uses are further known in the art, for example as disclosed in U.S. Pat. No. 8,794,373, the entire disclosure of which is incorporated herein by reference.

The foam scaffold can be but need not be a polymer foam. The foam could be made from another material such as a metal or ceramic. Preferably, the foam is a skeletal open-celled hydrophilic foam. One non-limiting example of such a foam is a melamine based foam. Another example is a polyurethane-based foam. Also the binder that is used to couple air adsorbing particles to the foam scaffold can include but is not limited to materials such as an acrylic material, a polyurethane material, or a polyacrylate material. The binder can be thermosetting or thermoplastic, for example.

The air-adsorbing and sound absorbing structures described herein can be used to increase the compliance of a waveguide. The box compliance increases associated with the air-adsorbing structure can be gauged by measuring the increase in the apparent volume of a sealed loudspeaker enclosure with and without the air-adsorbing structure. Box compliance data can be obtained by simultaneously measuring the transducer cone displacement and the pressure inside a sealed acoustic box, when signals are applied to the transducer. Box compliance is calculated as cone displacement×cone area/pressure.

When a loudspeaker enclosure or box contains air adsorption structure, the measured box compliance will increase. When a fixed amount/volume of air adsorption structure is present in a box, the more the box compliance increases, the greater the air adsorption capacity of the air adsorption structure.

"Apparent volume ratio" and "loss factor" are variables used herein to describe properties of the air adsorbent structures. Apparent volume ratio and loss factor may be defined as follows. Assume a box with air volume of $V_0$ before adding an air adsorbent structure with volume $V_m$. Two box compliance measurements are made. Measurement 1 is made without the air adsorbent structure, and the box compliance is termed $C_0$. Measurement 2 is made with the air adsorbent structure inside the same box, and the box compliance is termed $C_1$.

The compliance of the air adsorbent structure at unit volume is a complex number with real and imaginary parts. The real part is related to volume increase, or "apparent volume ratio." The imaginary part is related to the "loss factor." The apparent volume ratio of an air adsorbent structure is defined as:

$$\text{Apparent volume ratio}=\text{Real}(C_0/V_0-C_0/V_m+C_1/V_m)/\text{Real}(C_0/V_0)$$

The loss factor of an air adsorbent structure is defined as:

$$\text{Loss factor}=-\text{Imaginary}(C_0/V_0-C_0/V_m+C_1/V_m)/\text{Real}(C_0/V_0-C_0/V_m+C_1/V_m)$$

Figure 2:
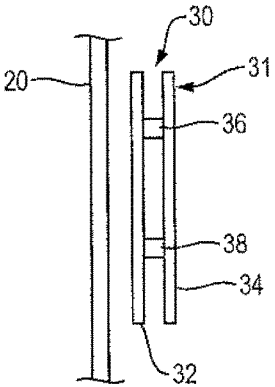
FIG. 2 is a partial schematic end view of another acoustically compliant waveguide.

FIG. 2 is a partial schematic end view of another acoustically compliant waveguide 30. Only part of one wall 20 of a waveguide duct is shown. Air adsorbent structure 31 comprises sheets 32 and 34 that contain air adsorbent material. More than one sheet can be used so as to achieve a desired thickness of the air adsorbent structure. The sheets can be stacked or they can be spaced so as to allow air flow between the sheets; this can facilitate the air reaching the adsorbent material, so that the material can adsorb and desorb air as pressure waves move past and through the sheets. Spacing in this schematic illustration is depicted via spacers 36 and 38 that separate sheets 32 and 34. The sheets can have a desired thickness, for example they can be less than about 3 mm thick, or they can be up to about 25 mm thick.

Figure 3:
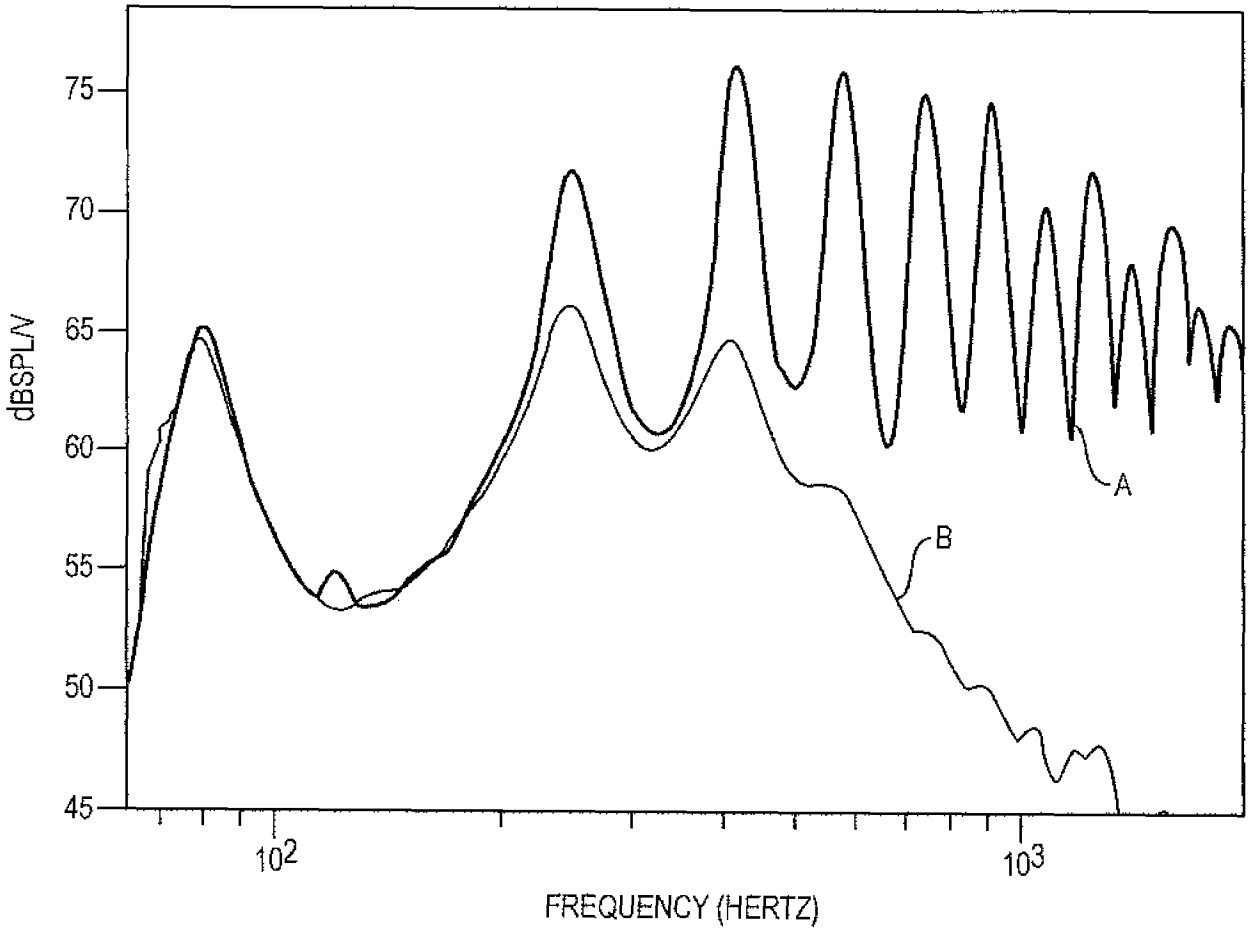
FIG. 3 compares the response (sound pressure level (dB) vs. frequency) of two waveguides, one with and the other without an air-adsorbent structure.

FIG. 3 compares the response (sound pressure level (dB) vs. frequency) of two waveguides, one with (curve B) and the other without (curve A) an air-adsorbent structure coupled to the inside of the waveguide duct. For curve A the waveguide was 99 cm long. For curve B the waveguide was 60 cm long and the entire inside was lined with an air-adsorbent sheet 2.9 mm thick. Both waveguides had the same free or open area (that is, the open area not filled with an air-adsorbent structure). A driver was coupled to the waveguides in the same manner as shown in FIG. 1. A microphone in the far field (more than one meter from the waveguide opening) was used to capture sound from just the waveguide. These data establish that an air-adsorbent structure lining a waveguide is effective to attenuate higher harmonics which are difficult to equalize. The air adsorbent structure thus can simplify system design and increase sound quality.

The air-adsorbent structure used in FIG. 3 had the properties shown in Table 1.

TABLE 1

| Frequency (Hz) | Apparent volume ratio | Loss factor |
|---|---|---|
| 100 | 2.73 | 0.09 |
| 200 | 2.64 | 0.18 |
| 400 | 2.6 | 0.34 |
| 600 | 2.15 | 0.65 |
| 800 | 2.06 | 0.71 |
| 1000 | 1.6 | 1.1 |

Figure 4:
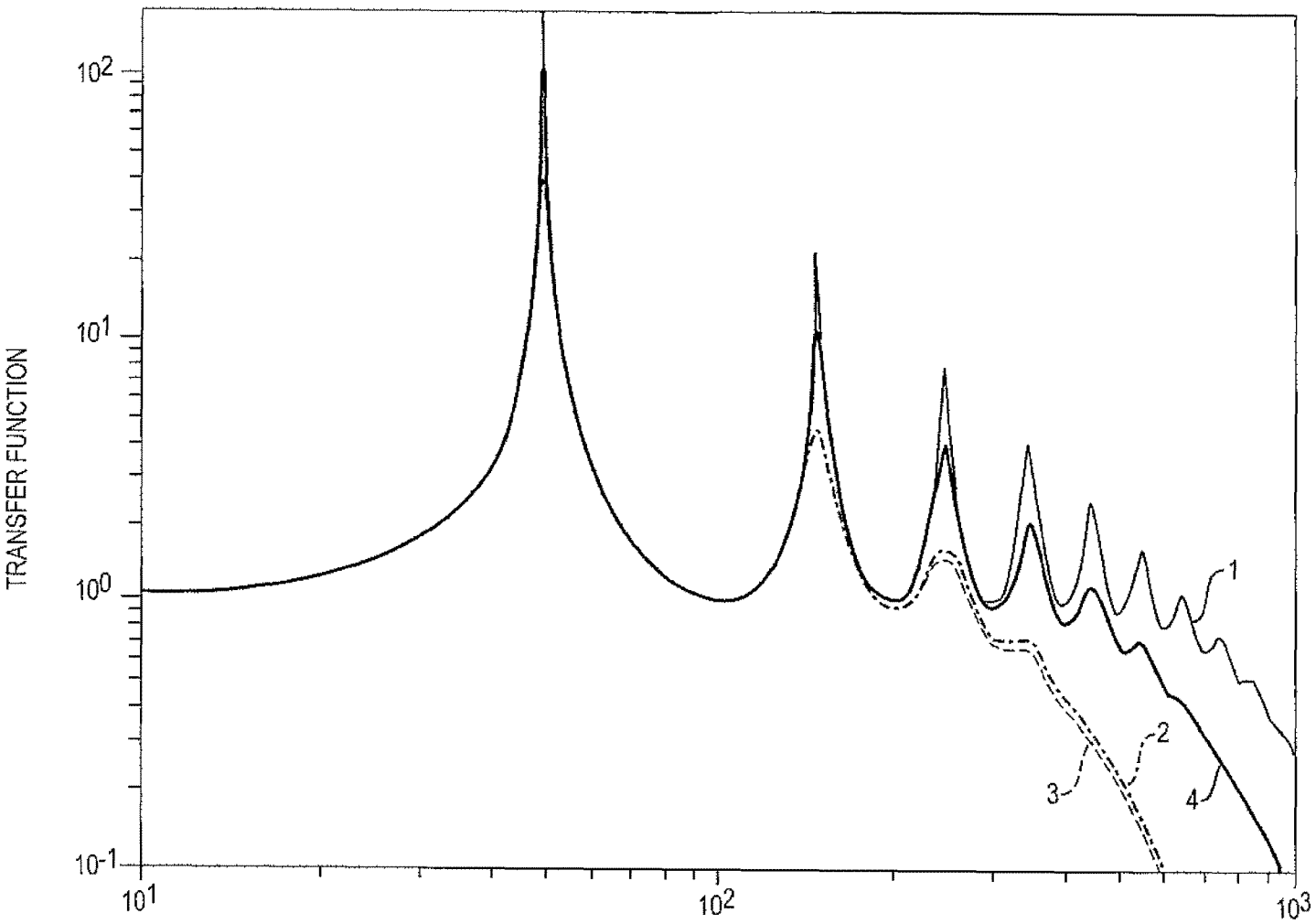
FIG. 4 illustrates the transfer function vs. frequency for four waveguides lined with air adsorbing structures.

FIG. 4 illustrates the transfer function (exit volume velocity per entrance volume velocity) vs. frequency for four rectangular waveguides with all four walls lined along their entire length with air adsorbing structure sheets (e.g., as shown in FIG. 1A). Parameters of the waveguides and the air-adsorbing structures are set forth in Table 2 below, and the acoustic properties of the air-adsorbing structures used are set forth in Table 3 below; the apparent volume ratio is about 1 (0.94) at 1000 Hz and is larger at lower frequencies. All of the waveguides provide the same waveguide fundamental tuning of 50 Hz and all have the same open cross-sectional area (the area that is not filled with air adsorbent structure sheets lining the walls) of 4 $cm^2$. The thickness is the thickness of the air adsorbing sheets. The "Q2-3" variable is the Q value of the second and third peaks (e.g., Q2-3 of 10-5 means the Q at the second peak at around 150 Hz equals 10 and the Q at the third peak at around 250 Hz equals 5). The volume is the total interior volume of the waveguide (including air and air adsorbing structures). The length is the total length of the waveguide. For reference, a waveguide without air adsorbing material would require a length of 1722 mm to achieve the same 50 Hz tuning, so the reduction in length by adding an adsorbing material is significant.

TABLE 2

| Identifier | Rz ratio | Area, air ($cm^2$) | Thickness (mm) | Q2-3 | Volume (cc) | Length (mm) |
|---|---|---|---|---|---|---|
| 1 | 0.7 | 4 | 3 | 51-31 | 590 | 868 |
| 2 | 3.0 | 4 | 6 | 10-5 | 747 | 467 |
| 3 | 10.0 | 4 | 6 | 10-5 | 1156 | 263 |
| 4 | 0.3 | 4 | 5 | 25-15 | 596 | 1146 |

TABLE 3

| Frequency | Apparent volume ratio | Loss factor |
|---|---|---|
| 100 | 3.48 | 0.33 |
| 200 | 2.75 | 0.56 |
| 400 | 1.85 | 0.87 |
| 600 | 1.38 | 1.07 |
| 800 | 1.02 | 1.38 |
| 1000 | 0.94 | 1.46 |

In general, the plots of FIG. 4 establish that thicker layers of air-adsorbent structures on the walls of a waveguide provide greater damping for a given frequency. More generally, the damping of a waveguide is affected by the volume of adsorption material present in the adsorbing structures—the more material, the more damping.

Figure 5:
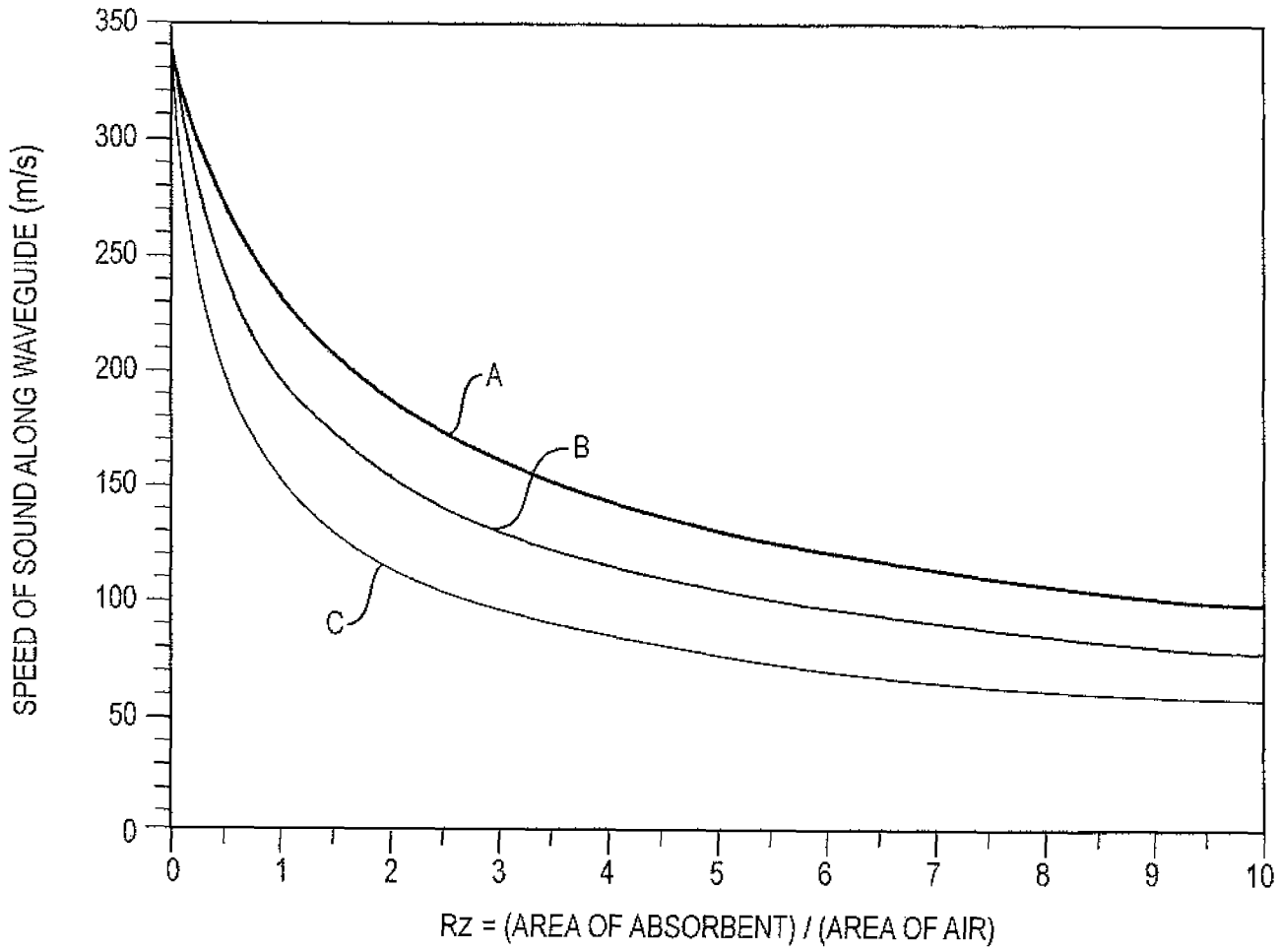
FIG. 5 illustrates an effect of the amount of air adsorbent on the speed of sound in a waveguide.

FIG. 5 illustrates the effect of the amount of air adsorbent on the speed of sound in a waveguide, with three different air adsorbing structures, each the same except for its bulk modulus. The bulk modulus of the sample used to generate curve A was about $1.2*e^5$ Pa, the bulk modulus of the sample used to generate curve B was about $7.0*e^4$ Pa, and the bulk modulus of the sample used to generate curve C was about 3.5*e$^4$ Pa. These data support the conclusions that lower bulk modulus of the air adsorbent structure leads to greater reduction in the speed of sound in a waveguide or horn, and that more air adsorbent has the same effect. Bulk modulus is defined as the change in pressure resulting from a change in volume of a fluid. The bulk modulus of air ($B_{air}$) at standard temperature and pressure compressed adiabatically is about 1.4*e$^5$ Pa/m$^3$. The relationship between bulk modulus ($B_m$) of an adsorption material and apparent volume ratio is:

$$B_m = B_{air}/(\text{Apparent Volume Ratio})$$

Figure 6:
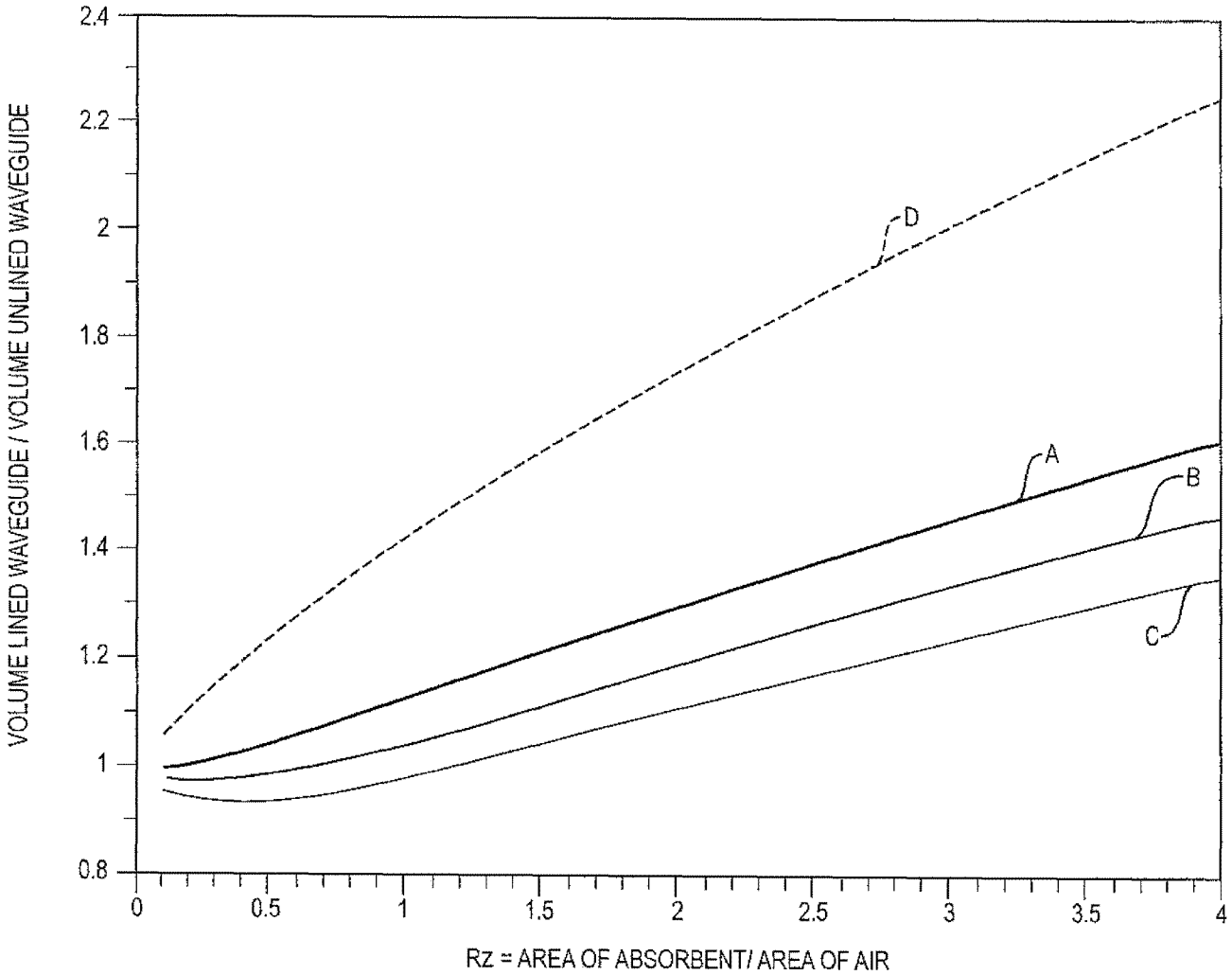
FIG. 6 illustrates an effect of the bulk modulus of an air adsorbent structure on the volume of a waveguide that is lined with the air adsorbent structure.

FIG. 6 illustrates an effect of the bulk modulus of an air adsorbent structure on the volume of a waveguide that is lined with the air adsorbent structure. FIG. 6 compares two waveguides (of constant cross section along their length and constant Rz along their length), one without any air adsorbent structure and another lined with air adsorbent structure in the manner shown in FIG. 1A. The waveguides have the same tuning frequency and the same air-only cross-sectional area ("area air"). The ratio of the volumes of the lined to unlined waveguides is set forth on the y axis. The x axis sets out the Rz ratio. Curve D is for reference and illustrates an air adsorbing structure with a bulk modulus the same as that of air. Curve A is for an air adsorbing structure with a bulk modulus about 1/2.2 times that of air (i.e., an apparent volume ratio of about 2.2), curve B is for an air adsorbing structure with a bulk modulus about 1/2.7 times that of air (i.e., an apparent volume ratio of about 2.7), and curve C is for an air adsorbing structure with a bulk modulus about 1/3.2 times that of air (i.e., an apparent volume ratio of about 3.2). FIG. 6 illustrates that for apparent volume ratios of about 2.2 and greater, the volume of the lined waveguide can be less than that of an unlined waveguide (i.e., the y axis value is less than 1.0). This means in part that a waveguide with about the same acoustic performance can be made smaller (i.e., have a smaller volume) by lining it with an air adsorbent structure that has an apparent volume ratio of about 2.2, or greater.

Figure 7A:
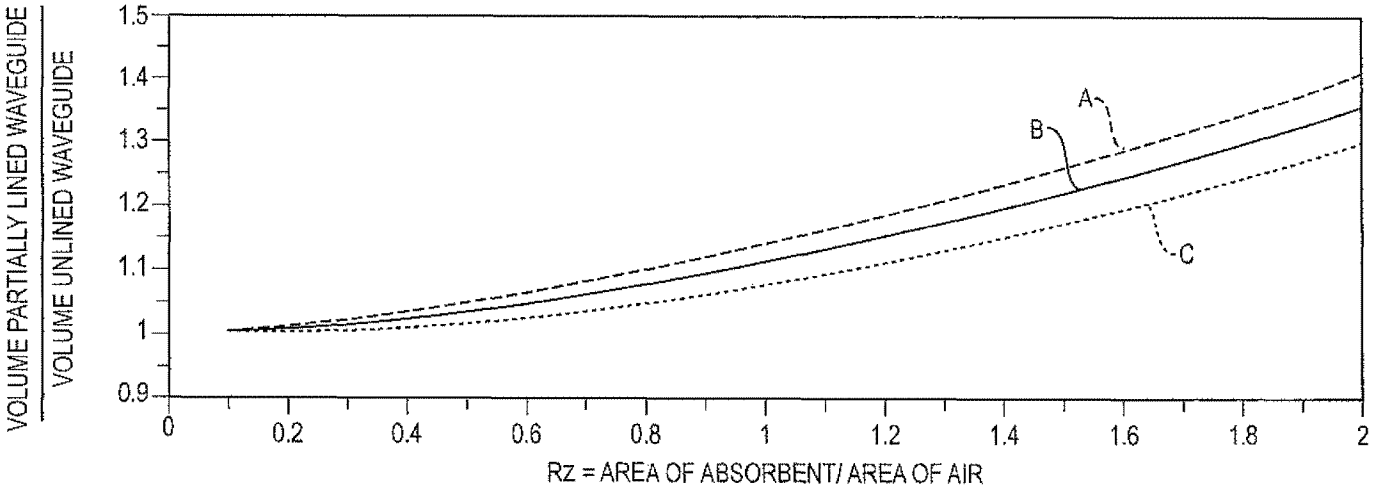
FIG. 7 illustrates benefits of lining a portion of a waveguide with an air-adsorbent structure.
Figure 7B:
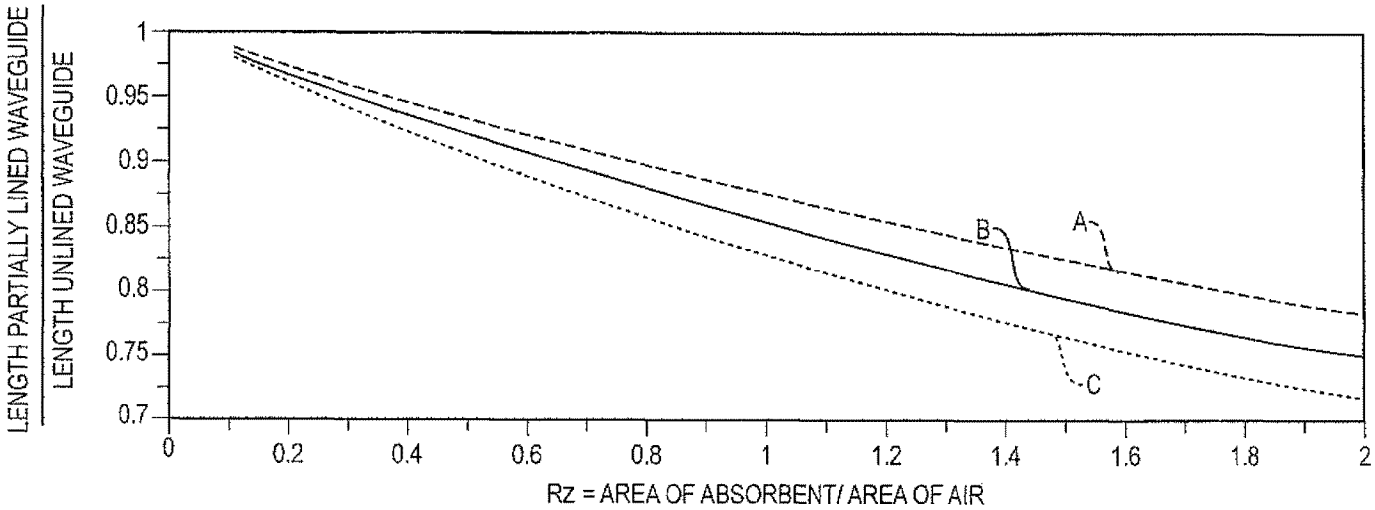

FIG. 7 includes two related plots that establish benefits of placing air adsorbent structures lining the walls of the waveguide. In this non-limiting example the air adsorbent structures are placed over only the first 10% of its length near the driver end of the waveguide. However, the benefits illustrated in FIG. 7 will apply to different degree for waveguides lined along less or more of their length, and where the lining is in locations that differ from the first 10% example illustrated here. Curve A is for an air adsorbent structure with an apparent volume ratio of 1.5, curve B is for an air adsorbent structure with an apparent volume ratio of 1.8, and curve C is for an air adsorbent structure with an apparent volume ratio of 2.2. As with the fully lined waveguide of FIG. 1 and the data presented for it, in the case of FIG. 7 the lined and unlined waveguides have the same tuning frequency and the same constant cross sectional "air area" along the waveguide length.

The top plot of FIG. 7 illustrates the ratio of volumes of lined to unlined waveguides, and the bottom plot illustrates the ratio of waveguide length of lined to unlined waveguides. In the top plot, a lower y axis value indicates that the volume of the lined waveguide is closer to that of an unlined waveguide, which is generally beneficial. In the bottom plot, a lower y axis value indicates that the lined waveguide is shorter than the unlined waveguide, which is also generally beneficial.

As is apparent from the data of FIG. 7, for the apparent volume ratios of 1.5, 1.8, and 2.2, the volume benefit of lining a waveguide over its first 10% with air adsorbent structure (top graph) is always greater or equal to 1. Also, if a shorter waveguide is important and total waveguide volume less important, there is a benefit to lining the waveguide with an air adsorbent structure with an apparent volume ratio of at least about 1.5. As one example taken from these data, for an Rz of 0.8 and apparent volume ratio of 1.5, the volume increase of the lined waveguide is less than 10%, but the reduction in length is greater than 10%.

Figure 8A:
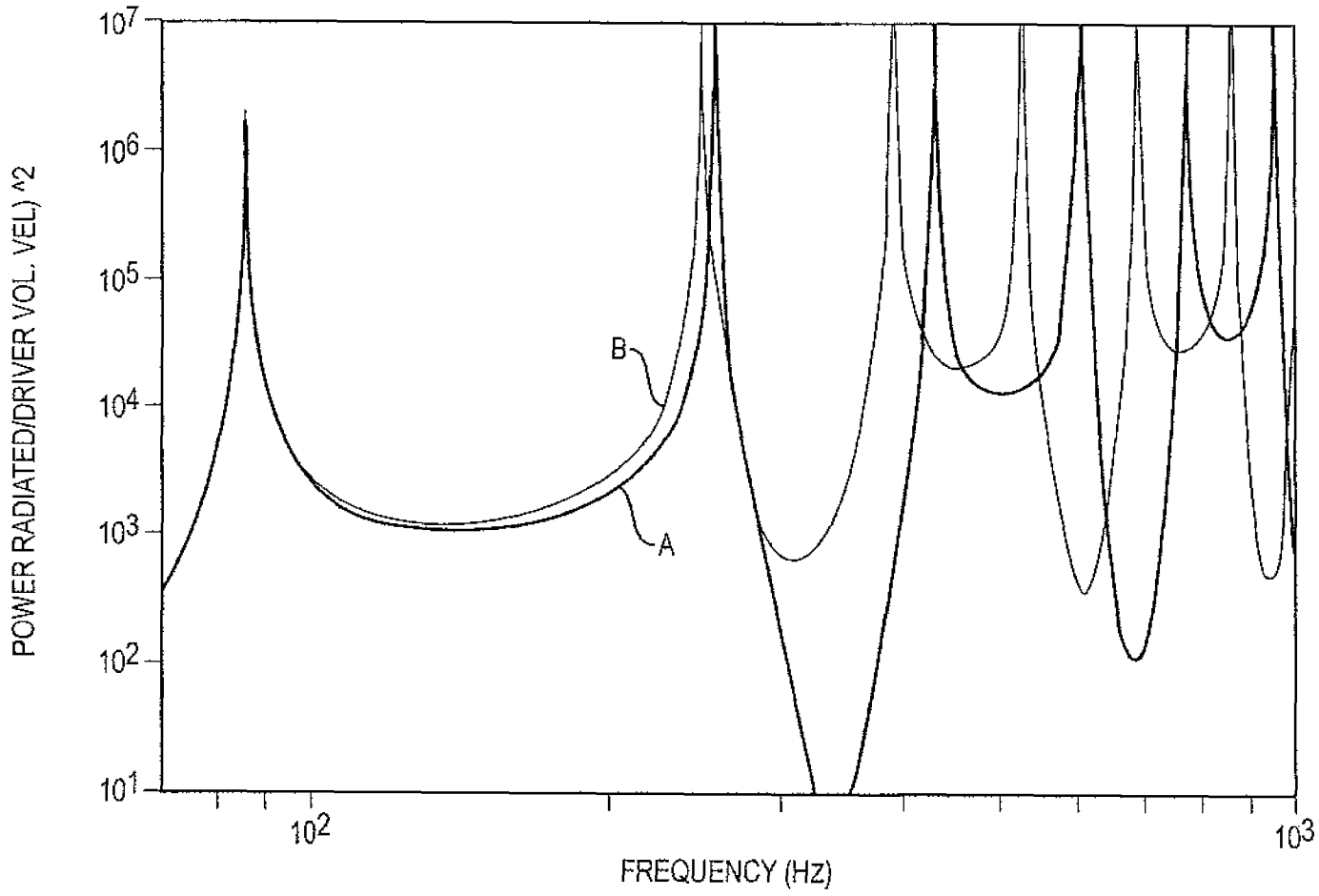
FIG. 8A illustrates the elimination of the deep notch in the frequency response of a waveguide that is lined near its mouth with an air-adsorbent structure.
Figure 8B:
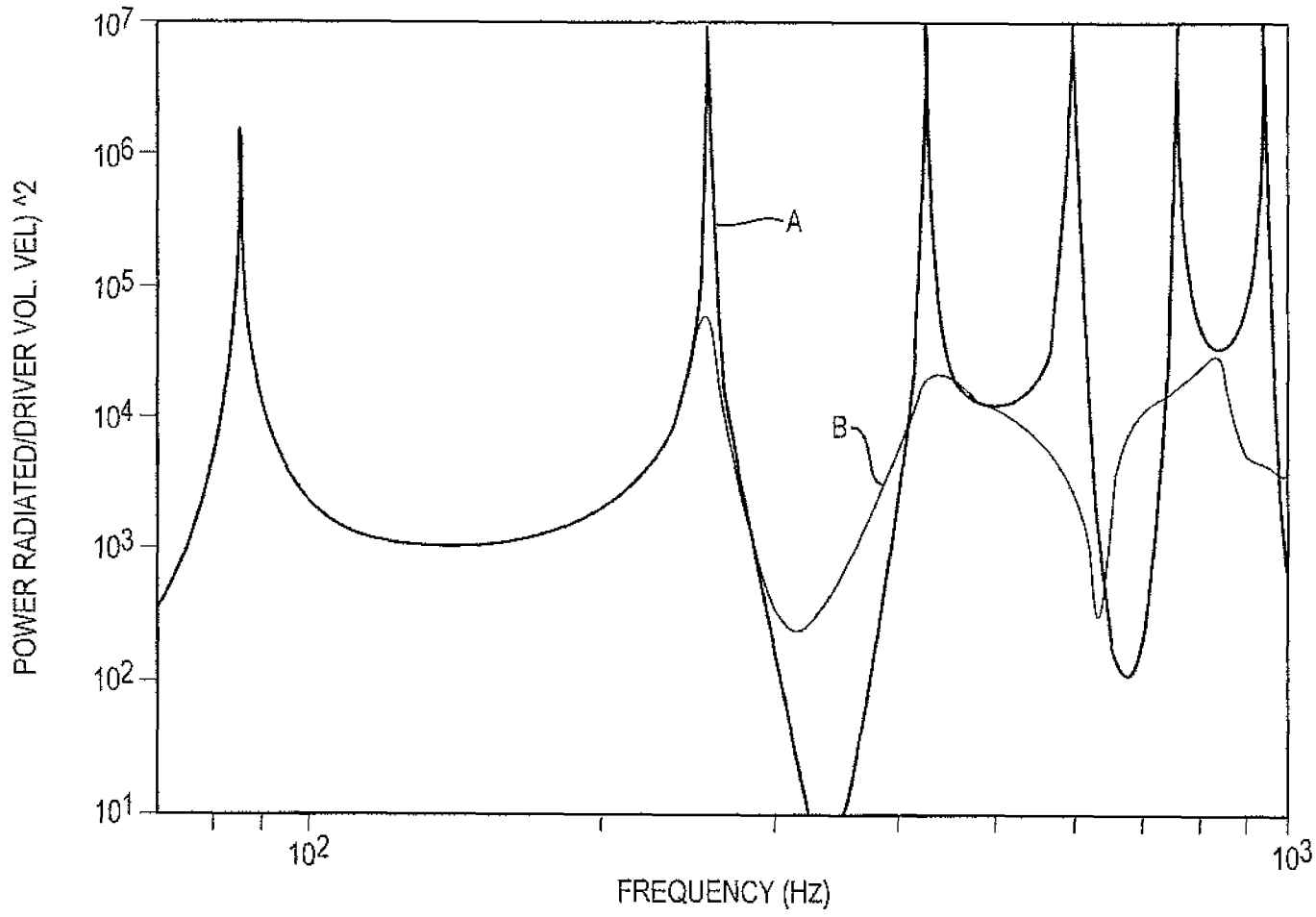
FIG. 8B illustrates smoothing of the frequency response of the lined waveguide of FIG. 8A when the air-adsorbent structure is also damping.

FIG. 8A illustrates elimination of the first deep notch at approximately 340 Hz in the frequency response of a waveguide that is lined near its mouth with an air-adsorbent structure. Curve "A" is data taken from a waveguide 1000 mm long without any air adsorbent structure, and for curve "B" the same waveguide was lined along the walls of the last 10% of its length (the 10% closest to the waveguide exit) with sheets of air adsorbent structure. These data establish that the frequency response is smoothed by the presence of air adsorbing material. FIG. 8B illustrates further smoothing of the frequency response of the same unlined and lined waveguide of FIG. 8A when the air-adsorbent structure is also effective to damp sound.

Figure 9A:
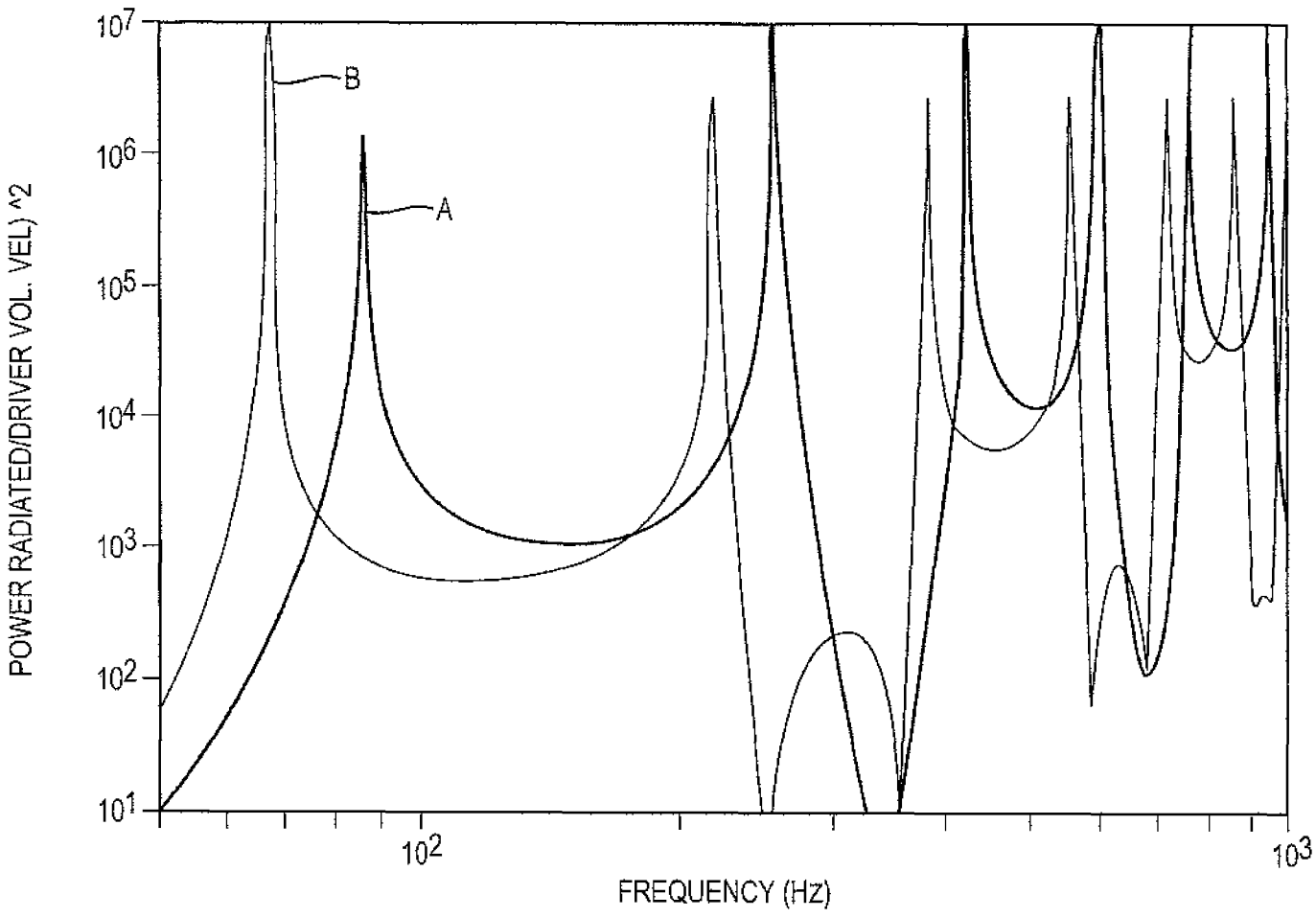
FIG. 9A illustrates the elimination of the deep notch in the frequency response of a waveguide that is lined near the transducer with an air-adsorbent structure.
Figure 9B:
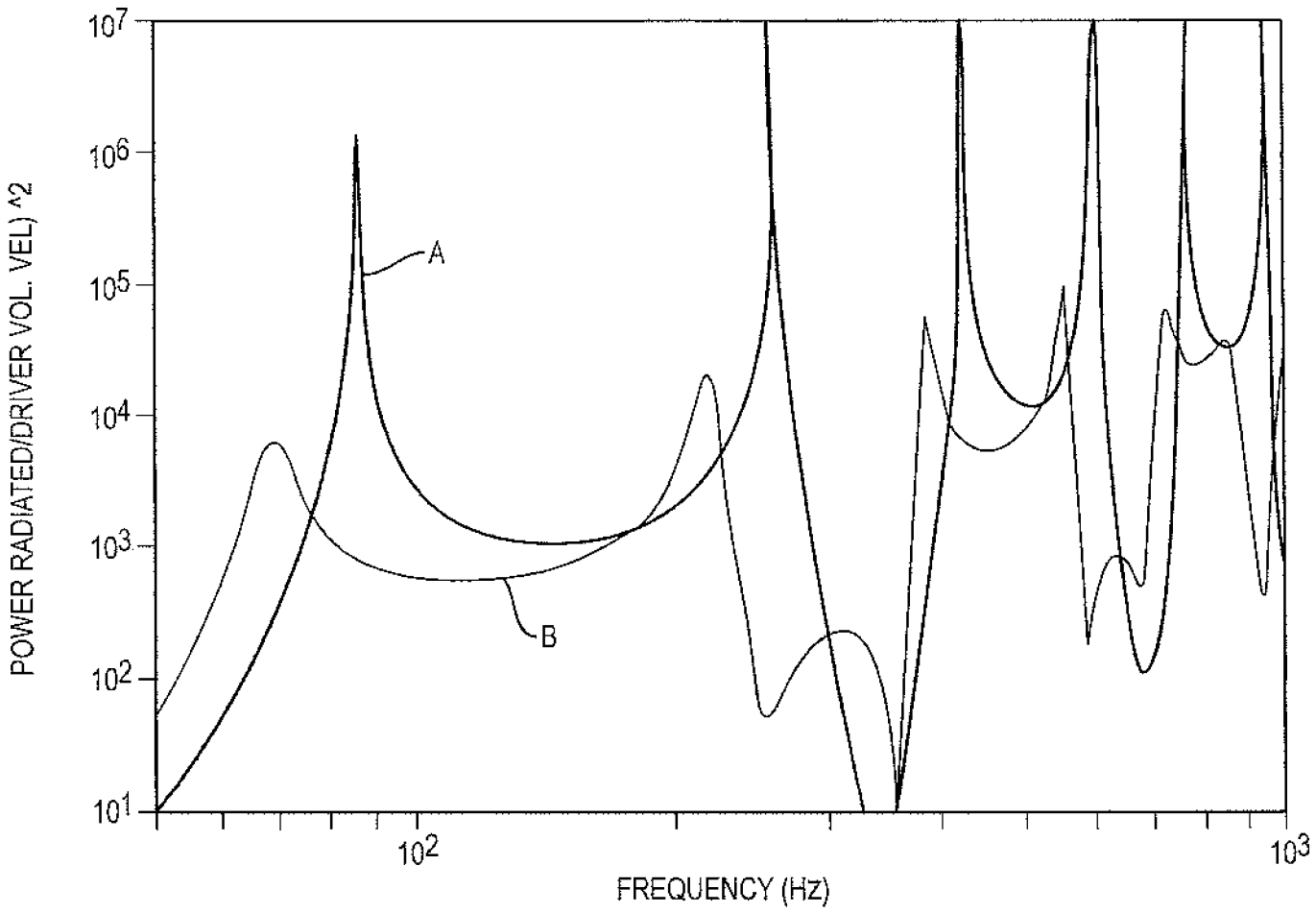
FIG. 9B illustrates smoothing of the frequency response of the lined waveguide of FIG. 9A when the air-adsorbent structure is also damping.

FIG. 9A illustrates elimination of the first deep notch at approximately 250 Hz in the frequency response of a waveguide that is lined near the transducer with an air-adsorbent structure. The only difference over the configuration of FIGS. 8A and 8B is that the lining of the waveguide of FIG. 9A was along the 10% of the length of the waveguide closest to the transducer rather than farthest from it. FIG. 9B illustrates further smoothing of the frequency response of the same unlined and lined waveguide of FIG. 9A when the air-adsorbent structure is also damping.

Figure 10:
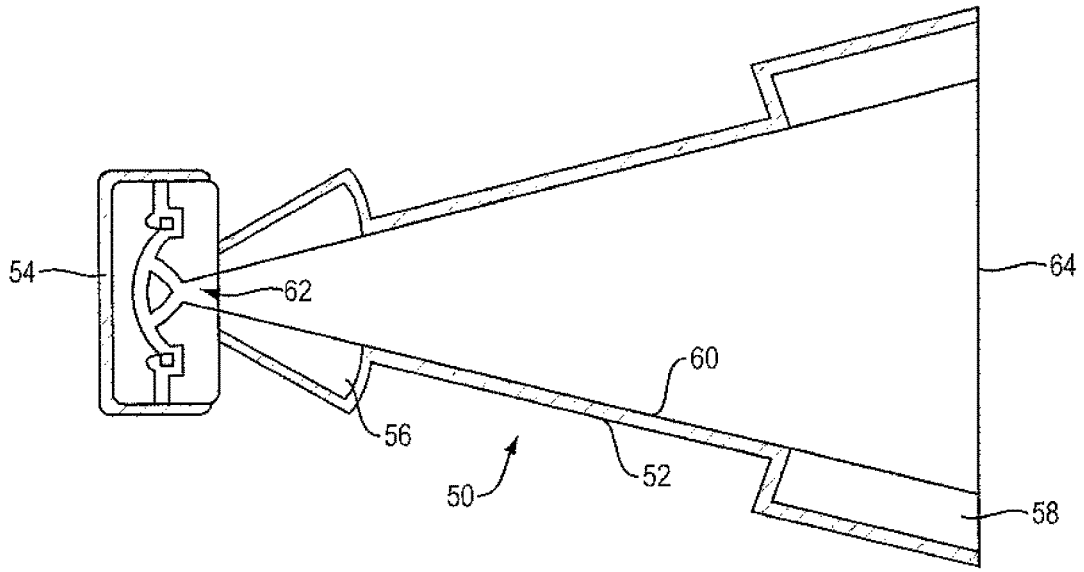
FIG. 10 is a schematic cross-sectional view of a horn loudspeaker.

An exemplary horn loudspeaker 50 is depicted in cross section FIG. 10. Horn loudspeaker 50 comprises transducer 54 coupled to the mouth 62 of conical duct or horn 52 that has interior surface 60 and exit 64. Interior surface 60 can be lined with adsorbent structures as disclosed above, and/or adsorbent structures can be located in circumferential recesses 56 and/or 58.

Figure 11:
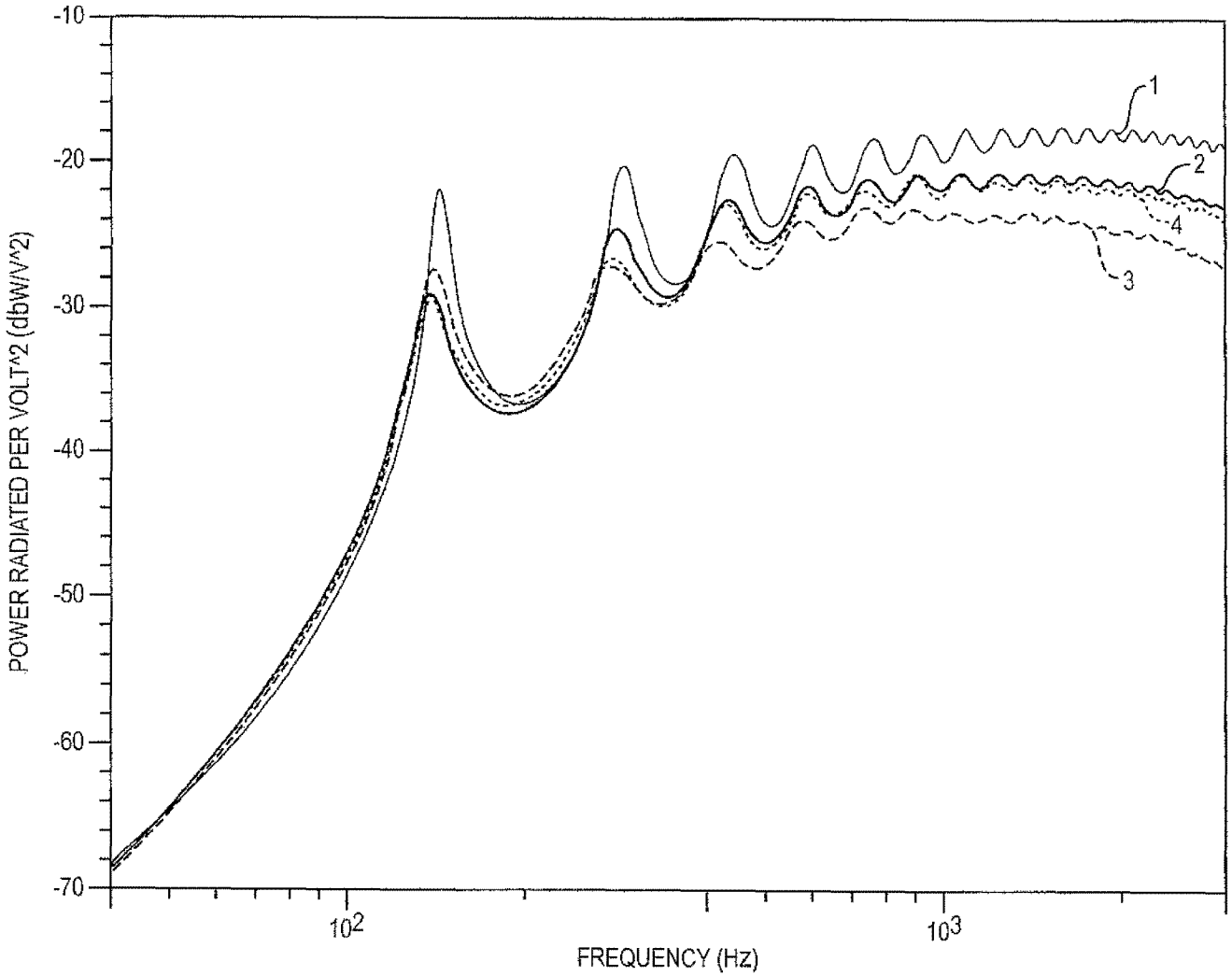
FIG. 11 illustrates the power radiated vs. frequency for four horns lined with air adsorbing structures.

FIG. 11 includes four curves illustrating acoustic power radiated per driver voltage squared for different combinations of adsorbent characteristics lining the same 1 m long horn, with 5 cm$^2$ throat area and 1250 cm$^2$ mouth area. Additional relevant horn and adsorbent parameters are provided in Table 4 below.

TABLE 4

| Identifier | Rz ratio | Thickness (mm) |
|---|---|---|
| 1 | N/A (no adsorption material) | 0 |
| 2 | 0.1 | 25 |
| 3 | 0.5 | 25 |
| 4 | 0.2 | 25 |

The horn of identifier 1 has no air adsorbent structure, that of identifier 2 has an air adsorbent structure placed long the first 50% of the length of the horn, that of identifier 3 has an air adsorbent structure placed long the first 20% of the length of the horn, and that of identifier 4 has an air adsorbent structure placed long the last 30% of the length of the horn. As can be seen in the curve for identifier 1, without adsorbent there are high Q peaks in the frequency response starting at 144 Hz, which is approximately the frequency where the horn loudspeaker could be operated from. All three adsorption designs lower the Q of the peaks and slightly reduce the frequency of the corresponding first, second, third, and additional peaks. The peaks of a horn speaker response are undesirable because they can make a speaker sound unnatural and because they can be difficult to remove through equalization. The frequency response has lower sensitivity above 400 Hz with the air adsorbent structures added, which is generally undesirable. However, in some applications this is an acceptable tradeoff for lower Q peaks. This is because the sensitivity (and efficiency) of the speaker is of concern where it is lowest, and this occurs below 300 Hz.

While not shown in the FIG. 10 or 11, adsorbent lining or filling of horns with air adsorbent structure could be useful in other horn types, such as exponential horns. Additionally, the entire length of the horn can be lined with air adsorbent structure to achieve the benefit of lowering the Q of the peaks. However, since the area of the horn is lowest near the throat, less air adsorbent structure would be needed if the lining was in this region.

Figure 12:
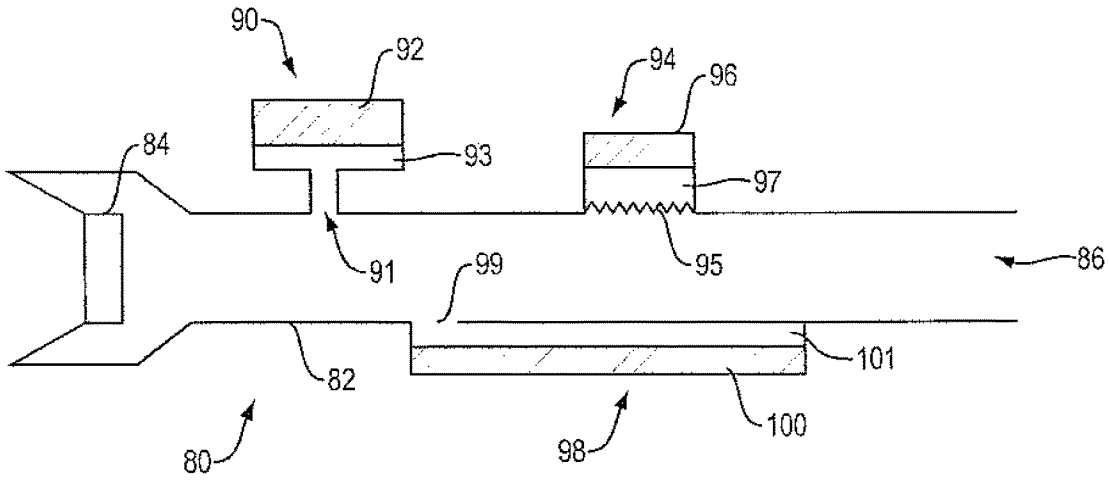
FIG. 12 is a schematic cross-sectional view of another acoustic waveguide.

FIG. 12 schematically illustrates a waveguide 80 with transducer 84 and duct 82 with exit 86. Helmholtz resonator 90, screened cavity 94 and waveguide shunt 98 are depicted, each of which is effective to adsorb air and can be used to smooth radiation peaks in the manner shown in FIG. 4. One or more of each of Helmholtz resonator 90, screened cavity 94 and shunt 98 would be located along the length of duct 82 such that entrance 91, 95 and/or 99 are located at a location of a standing wave pressure maxima in duct 82 (e.g., for the 3d, $5^{th}$ or $7^{th}$ harmonic). Adsorbent structures 92, 96 and 100 fill some or all of cavities 93, 97 and 101, respectively, such that they increase the apparent volumes of the cavities.

A number of implementations have been described. Nevertheless, it will be understood that additional modifications may be made without departing from the scope of the inventive concepts described herein, and, accordingly, other embodiments are within the scope of the following claims.

What is claimed is:

1. A waveguide for conducting sound that is generated by a loudspeaker that is acoustically coupled to the waveguide, comprising:

a duct with an external wall, an interior opening circumscribed by the wall, a cross-sectional area, and an outlet, wherein the duct is sized to resonate at frequencies within an operating range of the loudspeaker or is tapered to provide impedance matching with the surrounding environment; and an air-adsorbent structure coupled to an inside of the external wall of the duct such that the air adsorbent structure lines at least a portion of the wall, wherein along the lined portion of the wall some but not all of the cross-sectional area is filled with air-adsorbent structure;

wherein the apparent volume ratio of the air adsorbent structure is at least about 1.5.

2. The waveguide of claim 1 wherein the duct has a length between where the loudspeaker is coupled to the duct and the duct outlet, and wherein the air-adsorbent structure lines at least part of the wall over about the last 10% of the length.

3. The waveguide of claim 1 wherein the duct has a length between where the loudspeaker is coupled to the duct and the duct outlet, and wherein the air-adsorbent structure lines at least part of the wall over about the first 10% of the length.

4. The waveguide of claim 1 wherein the duct is tapered such that it is wider at the outlet than it is where it is coupled to the loudspeaker.

5. The waveguide of claim 1 wherein the air-adsorbent structure comprises an open-cell foam that carries particles of air-adsorbent material.

6. The waveguide of claim 5 wherein the air-adsorbent material comprises particles, particles are coupled to each other to form agglomerates, and the air-adsorbing material particles and agglomerates are coupled to the foam, wherein the air-adsorbent structure has structure openings in the agglomerates and structure openings between agglomerates, where at least some such structure openings are open to the outside environment, and wherein the openings in the air-adsorbent structure further comprise one or more channels through the thickness of the structure that have diameters of greater than the apparent diameter of the structure openings between agglomerates.

7. The waveguide of claim 5 wherein the air-adsorbent structure comprises a sheet of open-cell foam that carries particles of air-adsorbent material.

8. The waveguide of claim 7 wherein the air-adsorbent structure comprises a plurality of stacked sheets of the open-cell foam that carries particles of air-adsorbent material.

9. The waveguide of claim 8 further comprising spacers between stacked sheets, to allow ventilation between sheets.

10. The waveguide of claim 1 wherein a thickness of the air-adsorbent structure is less than about 3 mm.

11. The waveguide of claim 1 wherein a thickness of the air-adsorbent structure is no more than about 25 mm.

12. The waveguide of claim 1 wherein along the lined portion of the wall the ratio of an area of air adsorbent structure to the open area of the duct is at least about 0.1.

13. The waveguide of claim 12 wherein along the lined portion of the wall the ratio of an area of air adsorbent structure to the open area of the duct is no greater than 10.

14. The waveguide of claim 1 further comprising at least one of a Helmholtz resonator, a screened cavity, and a waveguide shunt located along the length of the duct.

15. The waveguide of claim 14 wherein an entrance to the Helmholtz resonator, a screened cavity, and a waveguide shunt is at a location of a standing wave pressure maximum in the duct.

16. The waveguide of claim 1 wherein the apparent volume ratio of the air adsorbent structure is at least about 2.2.

17. A waveguide for conducting sound that is generated by a loudspeaker that is acoustically coupled to the waveguide, comprising:

a duct with an external wall, an interior opening circumscribed by the wall, a cross-sectional area, and an outlet, wherein the duct is sized to resonate at frequencies within an operating range of the loudspeaker or is tapered to provide impedance matching with the surrounding environment; and an air-adsorbent structure comprising an open-cell foam that carries particles of air-adsorbent material, where the air-adsorbent structure is coupled to an inside of the external wall of the duct such that the air adsorbent structure lines at least a portion of the wall, wherein along the lined portion of the wall some but not all of the cross-sectional area is filled with air-adsorbent structure;

wherein the apparent volume ratio of the air adsorbent structure is at least about 1.5, and wherein along the lined portion of the wall the ratio of an area of air adsorbent structure to the open area of the duct is at least about 0.1.

18. The waveguide of claim 17 wherein the air-adsorbent structure comprises a sheet of open-cell foam that carries particles of air-adsorbent material.

19. The waveguide of claim 18 wherein the air-adsorbent structure comprises a plurality of stacked sheets of the open-cell foam that carries particles of air-adsorbent material.

20. A waveguide for conducting sound that is generated by a loudspeaker that is acoustically coupled to the waveguide, comprising:

a duct with an external wall, an interior opening circumscribed by the wall, a cross-sectional area, and an outlet, wherein the duct is sized to resonate at frequencies within an operating range of the loudspeaker or is tapered to provide impedance matching with the surrounding environment; and an air-adsorbent structure comprising a plurality of stacked sheets of open-cell foam that carries particles of air-adsorbent material, where the air-adsorbent structure is coupled to an inside of the external wall of the duct such that the air adsorbent structure lines at least a portion of the wall, wherein along the lined portion of the wall some but not all of the cross-sectional area is filled with air-adsorbent structure;

wherein along the lined portion of the wall the ratio of an area of air adsorbent structure to the open area of the duct is at least 0.1 and is no greater than 10; and wherein the apparent volume ratio of the air adsorbent structure is at least about 1.5.

21. The waveguide of claim 20 further comprising spacers between the stacked sheets, to allow ventilation between sheets.

* * * * *